US009587920B1

(12) United States Patent
Yoon et al.

(10) Patent No.: US 9,587,920 B1
(45) Date of Patent: Mar. 7, 2017

(54) NON-PYROTECHNIC, NON-LETHAL SPRING POWERED DISSEMINATOR

(71) Applicant: U.S. Army Edgewood Chemical and Biological Command, Washington, DC (US)

(72) Inventors: Elias W. Yoon, Elkridge, MD (US); Daniel G. Wise, Ellicott City, MD (US); Daniel J. Weber, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/869,430

(22) Filed: Sep. 29, 2015

(51) Int. Cl.

| | |
|---|---|
| ***F42B 27/00*** | (2006.01) |
| ***F42B 8/26*** | (2006.01) |
| ***F42B 12/50*** | (2006.01) |
| ***F42C 14/02*** | (2006.01) |

(52) U.S. Cl.
CPC ..... *F42B 12/50* (2013.01); *F42B 8/26* (2013.01); *F42B 27/00* (2013.01); *F42C 14/02* (2013.01)

(58) Field of Classification Search
CPC ..... F42B 27/00; F42B 8/26; F42C 14/02
USPC ..... 102/368, 482, 498
See application file for complete search history.

(56) References Cited

U.S. PATENT DOCUMENTS

| | | | | | |
|---|---|---|---|---|---|
| 3,618,522 | A * | 11/1971 | Henderson | F42C 14/02 | 102/222 |
| 3,678,857 | A * | 7/1972 | Evans | F42B 27/00 | 102/368 |
| 3,878,639 | A * | 4/1975 | Scheelar | F42B 12/50 | 434/11 |
| 4,059,917 | A * | 11/1977 | Sims | A63H 5/00 | 124/2 |
| 4,319,426 | A * | 3/1982 | Lee | A63H 5/04 | 102/498 |
| 4,944,521 | A * | 7/1990 | Greeno | F42B 12/50 | 102/498 |
| 4,976,201 | A * | 12/1990 | Hamilton | F42B 27/00 | 102/275.3 |
| 5,018,449 | A * | 5/1991 | Eidson, II | F42B 12/40 | 102/248 |
| 5,753,849 | A * | 5/1998 | Posey | F42C 15/32 | 102/223 |

(Continued)

*Primary Examiner* — Alexander Niconovich
(74) *Attorney, Agent, or Firm* — Ulysscs John Biffoni

(57) ABSTRACT

A non-pyrotechnic disseminator includes a body portion with a cover; a first compartment that holds disseminating materials; a spring-loaded piston; a cable connecting the piston to a base of the body portion: a second compartment adjacent to the first compartment; a control mechanism; and an initiator mechanism. The control mechanism sets a delay timing countdown for initiation of dissemination of the disseminating materials out of the body portion. The initiator mechanism begins the delay timing countdown. The second compartment includes a delay fuze module; and a cutting mechanism in contact with the cable. The delay fuze module processes the delay timing countdown, and upon expiration of the countdown, sends a signal to the cutting mechanism to cut the cable. When the cable cuts, the spring uncoils and pushes the piston, which forces the disseminating materials out of the body portion by rupturing the cover.

18 Claims, 5 Drawing Sheets

(56) References Cited

U.S. PATENT DOCUMENTS

| | | | | | |
|---|---|---|---|---|---|
| 5,996,503 | A * | 12/1999 | Woodall | F42B 12/60 | 102/482 |
| 6,047,644 | A * | 4/2000 | Malecki | F41H 9/06 | 102/334 |
| 6,453,819 | B1 * | 9/2002 | Coates | F42B 8/26 | 102/498 |
| 6,871,594 | B1 * | 3/2005 | Estrella | F41H 9/10 | 102/368 |
| 7,784,455 | B1 * | 8/2010 | Chong | F41B 11/62 | 102/498 |
| 7,975,615 | B1 * | 7/2011 | Apple | F42B 5/15 | 102/512 |
| 8,469,011 | B2 * | 6/2013 | Mroczka | F41B 7/00 | 124/16 |
| 8,733,334 | B2 * | 5/2014 | Mroczka | F41B 7/00 | 124/1 |
| 8,899,156 | B1 * | 12/2014 | Tseng | F42B 27/00 | 102/368 |
| 2003/0036335 | A1 * | 2/2003 | Juy | A63H 5/04 | 446/181 |
| 2008/0257193 | A1 * | 10/2008 | Siu | F42B 8/26 | 102/498 |
| 2012/0266852 | A1 * | 10/2012 | Mroczka | F41B 7/00 | 124/16 |
| 2012/0266853 | A1 * | 10/2012 | Mroczka | F41B 7/00 | 124/16 |

* cited by examiner

NON-PYROTECHNIC, NON-LETHAL SPRING POWERED DISSEMINATOR

GOVERNMENT INTEREST

The embodiments described herein may be manufactured, used, and/or licensed by or for the United States Government.

BACKGROUND

Technical Field

The embodiments herein generally relate to hand grenade sized dissemination devices, and more particularly to non-pyrotechnic disseminators.

Description of the Related Art

The conventional CS (teargas) grenade (M7A3), shown in FIGS. 1A and 1B, relies on a burning pyrotechnic to disseminate 128 g of pelletized CS which results in approximately 45-50 grams of CS dispersed as an aerosol. Pyrotechnic disseminators can burn some of the CS, destroying its active properties, as well as posing a high risk of starting fires. The threat of fire limits the grenade's operational uses to outdoors scenarios under controlled conditions that reduce the risk of fires. Pyrotechnic devices operate over an extended period of time, typically measured in tens of seconds to minutes.

Bursting type grenades can provide a near instantaneous disseminated cloud. The obsolete ABC-M25 A2, shown in FIGS. 2A and 2B, is an example of this type of grenade that uses an explosive detonator to expel the CS1 fill (~57 g). A bursting grenade has a reduced risk of fire hazard, but due to its method of operation can cause injury to personnel from flying grenade body shrapnel.

A number of commercial riot control disseminators are available. These devices typically rely on pyrotechnics, explosives, or propellants (gas) to disseminate the riot control agent, and most use pyrotechnic fuze/delay systems. The pyrotechnic devices generally employ double and triple walled configurations to contain the pyrotechnic flame internally to try to reduce the risk of starting fires.

Furthermore, there are a number of devices that use compressed springs to propel a projectile, although many of these devices are focused on the toy and paintball industries, and whose primary function is to propel small projectiles. An example conventional grenade type device that uses compressed springs in its operation is provided below, the complete disclosure of which, in its entirety, is herein incorporated by reference.

U.S. Pat. No. 8,061,276 issued to Danon et al. for a "Non-Lethal Projectile" uses an internal spring to absorb energy upon impact of the device with the intended target. While this conventional solution is suitable for the purpose for which it was designed, it generally does not provide a suitable solution for both non-pyrotechnic and non-lethal uses, and accordingly there remains a need for a new non-pyrotechnic, non-lethal compressed spring powered disseminator.

SUMMARY

In view of the foregoing, an embodiment herein provides a non-pyrotechnic disseminator comprising a body portion; a cover on the body portion; a first compartment adjacent to the cover, wherein the first compartment is configured to hold disseminating materials; a piston in the first compartment; a spring attached to the piston and a base of the first compartment; a cable connecting the piston to a base of the body portion; a second compartment adjacent to the first compartment; a control mechanism operatively connected to the second compartment; and an initiator mechanism operatively connected to the second compartment. The control mechanism may set a delay timing countdown for initiation of dissemination of the disseminating materials out of the body portion. The initiator mechanism may begin the delay timing countdown.

The second compartment may comprise a delay fuze module; and a cutting mechanism in contact with the cable. The delay fuze module may process the delay timing countdown, and upon expiration of the countdown, sends a signal to the cutting mechanism to cut the cable. Upon cutting of the cable, the spring may uncoil and push the piston towards the cover thereby pushing the disseminating materials out of the body portion by rupturing the cover. The non-pyrotechnic disseminator may further comprise an actuating mechanism operatively connected to the second compartment, wherein actuation of the actuating mechanism activates the delay fuze module, allowing the delay timing countdown to be set by the control mechanism and initiated by the initiator mechanism, and wherein expiration of the countdown immediately causes the cutting mechanism to cut the cable. The disseminating materials may exit the body portion as an aerosol. The disseminating materials may comprise any of a powder, slurry, and liquid. The non-pyrotechnic disseminator may further comprise a self-righting mechanism operatively connected to the body portion.

Another embodiment provides a grenade comprising a body portion; a first compartment configured in the body portion, wherein the first compartment is configured to hold disseminating materials; a force transfer device in the first compartment; an energy storage device attached to the force transfer device by a cable; a control mechanism operatively connected to the body portion; and an initiator mechanism operatively connected to the body portion. The grenade may further comprise a cover on the body portion; and a second compartment adjacent to the first compartment, wherein the energy storage device is attached to a base of the first compartment, wherein the control mechanism sets a delay timing countdown for initiation of dissemination of the disseminating materials out of the body portion, and wherein the cable is connected to a base of the body portion. The initiator mechanism may begin the delay timing countdown.

The second compartment may comprise a delay fuze module; and a dislodgment mechanism in contact with the cable. The delay fuze module may process the delay timing countdown, and upon expiration of the countdown, sends a signal to the dislodgment mechanism to dislodge the cable. Upon dislodging of the cable, the energy storage device may transfer energy to the force transfer device, which transfers a force towards the cover thereby pushing the disseminating materials out of the body portion past the cover. The grenade may further comprise an actuating mechanism operatively connected to the second compartment, wherein actuation of the actuating mechanism sends a signal to the delay fuze module, and wherein expiration of the countdown immediately causes the dislodgment mechanism to dislodge the cable from the base of the body portion. The disseminating materials may exit the body portion as an aerosol. The disseminating materials may comprise any of a powder, slurry, and liquid. The grenade may further comprise a self-righting mechanism operatively connected to the body portion.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1B:
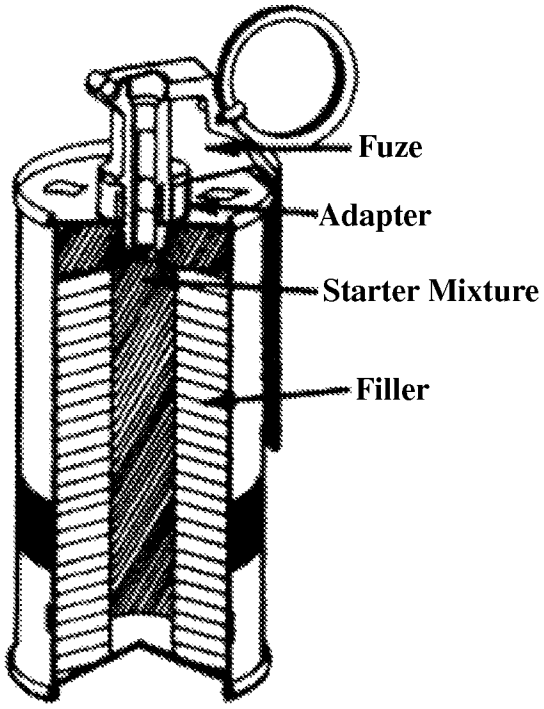
FIG. 1B (Prior Art)
FIG. 1B illustrates a sectional view of the M7A3 CS hand grenade of FIG. 1A.
Figure 1A:
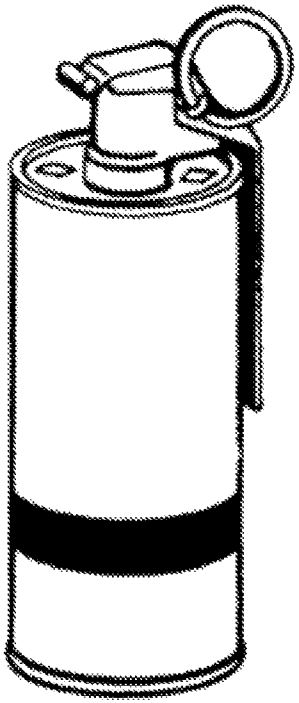
FIG. 1A (Prior Art)
FIG. 1A illustrates a perspective view of a conventional M7A3 CS hand grenade.
Figure 2B:
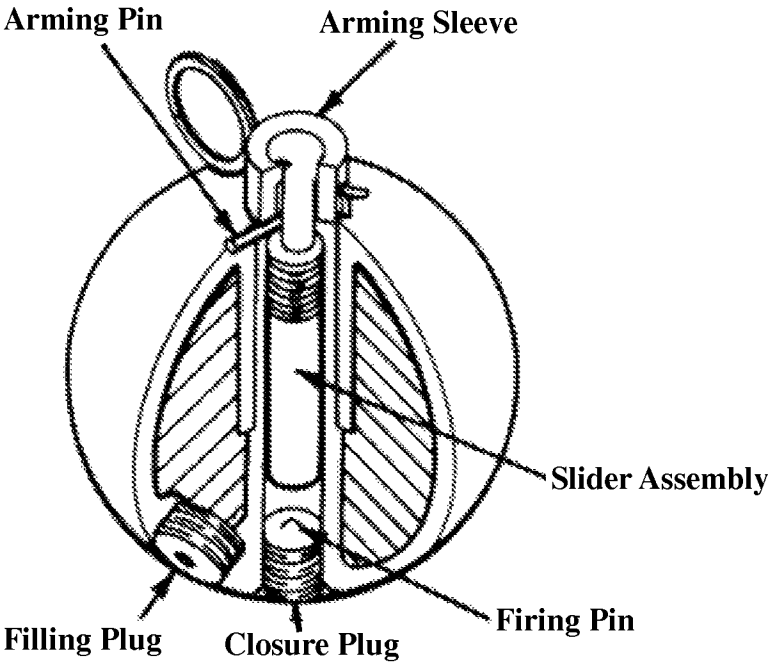
FIG. 2B (Prior Art)
FIG. 2B illustrates a sectional view of the ABC-M25A2 grenade of FIG. 2A.
Figure 2A:
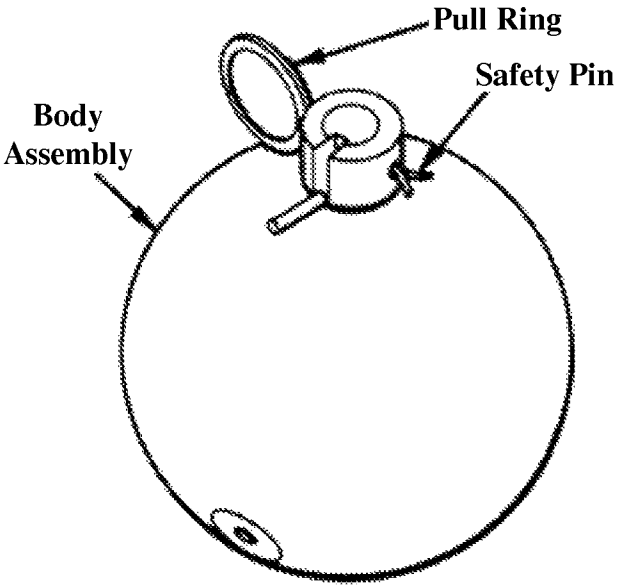
FIG. 2A (Prior Art)
FIG. 2A illustrates a perspective view of a conventional ABC-M25A2 grenade.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a non-pyrotechnic hand grenade sized device for the dissemination of powders and other disseminating materials, such as non-lethal riot control agents. The device is applicable to many riot control situations, and is particularly advantageous for use within confined spaces, such as buildings, where the risk of starting a fire is greatest. Being completely non-pyrotechnic allows the device to be classified as non-munitions which significantly reduces handling and storage requirements. Referring now to the drawings, and more particularly to FIGS. 3A through 3D, where similar reference characters denote corresponding features consistently throughout the figures, there are shown preferred embodiments.

A non-pyrotechnic powder disseminator for dispersing non-lethal riot control material rapidly is desirable both from a military and law enforcement perspective. As provided in FIGS. 3A through 3C, the embodiments herein achieve this by providing a non-pyrotechnic disseminator 10, which may be configured as a grenade, comprising a body portion 12; a cover 15 on the body portion 12; a first compartment 20 adjacent to the cover 15, wherein the first compartment 20 is configured to hold disseminating materials 80; a force transfer device 30, which may be configured as a piston, in the first compartment 20 opposite cover 15; an energy storage device 60, which may be configured as a spring, attached to the force transfer device (e.g., piston) 30 and the base 63 of the first compartment 20; at cable 70 connecting the force transfer device (e.g., piston) 30 to the base 72 of the body portion 12 by passing through the center of the energy storage device (e.g., spring) 60 and through the delay fuze module 71; a second compartment 75 adjacent to the first compartment 20; a control mechanism 90 operatively connected to the second compartment 75; and an initiator mechanism 65, which may be configured as a button, operatively connected to the second compartment 75.

The control mechanism 90 is configured to set a delay timing countdown for initiation of dissemination of the disseminating materials 80 out of the body portion 12. The initiator mechanism 65 is configured to begin the delay timing countdown. The second compartment 75 comprises a delay fuze module 71 and a dislodgment mechanism 95, which may be configured as a cutting mechanism, in contact with the cable 70. The delay fuze module 71 is configured to process the delay timing countdown, and upon expiration of the countdown, sends a signal to the dislodgment mechanism (e.g., cutting mechanism) 95 to dislodge or cut the cable 70. Upon dislodging or cutting of the cable 70, the energy storage device (e.g., spring) 60 uncoils and pushes the force transfer device (e.g., piston) 30 towards the cover 15 thereby pushing the disseminating materials 80 out of the body portion 12 by rupturing the cover 15. The non-pyrotechnic disseminator 10 further comprises an actuating mechanism 50 operatively connected to the second compartment 75, wherein actuation of the actuating mechanism 50 activates said delay fuze module (71), allowing the delay timing countdown to be set by said control mechanism (90) and initiated by said initiator mechanism (65), and wherein expiration of the countdown immediately causes the dislodgment mechanism (e.g., cutting mechanism) 95 to dislodge (e.g., cut) the cable 70.

Preferably, the embodiments herein utilize a metallic high compressive force spring to push non-lethal fluidized CS powder 80 out of one end of a cylindrical shaped grenade body 12. The energy storage device (e.g., spring) 60 is contained within the first compartment 20, which extends for most of the entire length of the body portion 12. In one embodiment, the energy storage device 60 is configured as a tapered spring. As an example, the tapered spring could be configured with a major diameter of 2.375-in to match the inner diameter of the body portion 12 and a minor diameter of 1.625-in and an average spring constant of 22.3 lbf/in or greater.

One end 62 of the energy storage device (e.g., spring) 60 is physically attached to the base 63 of the second compartment 75 of the body portion 12, and the other end 64 of the energy storage device (e.g., spring) 60 is biased against and attaches to the force transfer device (e.g., piston) 30 and is able to move the force transfer device (e.g., piston) 30 based on the predetermined compressive strength of the energy storage device (e.g., spring) 60. The force transfer device (e.g., piston) 30 is selectively sized with a diameter just smaller than the diameter of the body portion 12 and the diameter of the first compartment 20, thereby providing a light seal to keep the payload powder 80 from falling below the force transfer device (e.g., piston) 30.

Figure 3B:
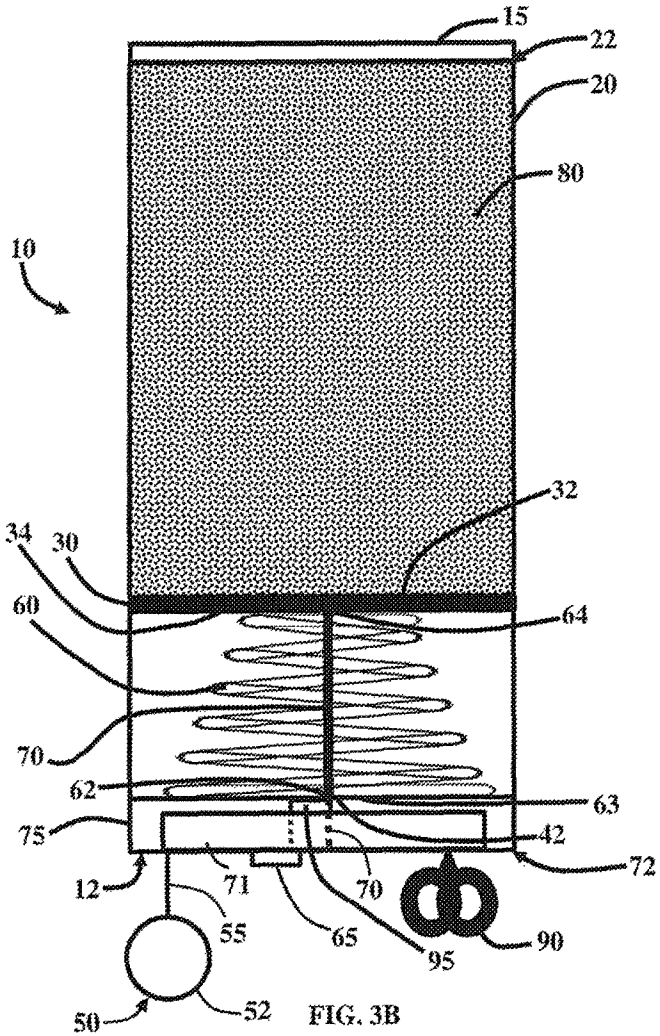
FIG. 3B illustrates a sectional view the spring powered disseminator of FIG. 3A according to an embodiment herein.
Figure 3A:
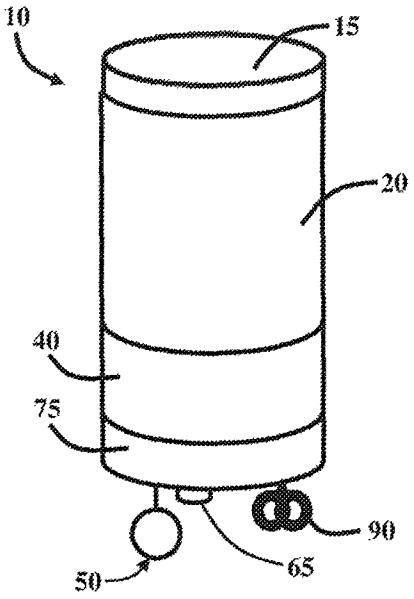
FIG. 3A illustrates a perspective view a spring powered disseminator according to an embodiment herein.

In its operational state, as generally shown in FIGS. 3A and 3B, the energy storage device (e.g., spring) 60 and force transfer device (e.g., piston) 30 are compressed into the base portion 40 of the first compartment 20 and held securely in place by the thin retention cable 70 attached between the base 72 of the body portion 12 and the bottom 34 of the force transfer device (e.g., piston) 30. The payload powder 80 is loaded on top 32 of the force transfer device (e.g., piston) 30, and a thin cover 15 is placed over the open end 22 to seal off the first compartment 20. Located under and adjacent to the energy storage device (e.g., spring) 60 at the base 72 of the body portion 12 is the second compartment 75, which comprises a mechanical or electronic time delay fuze module 71.

Figure 3C:
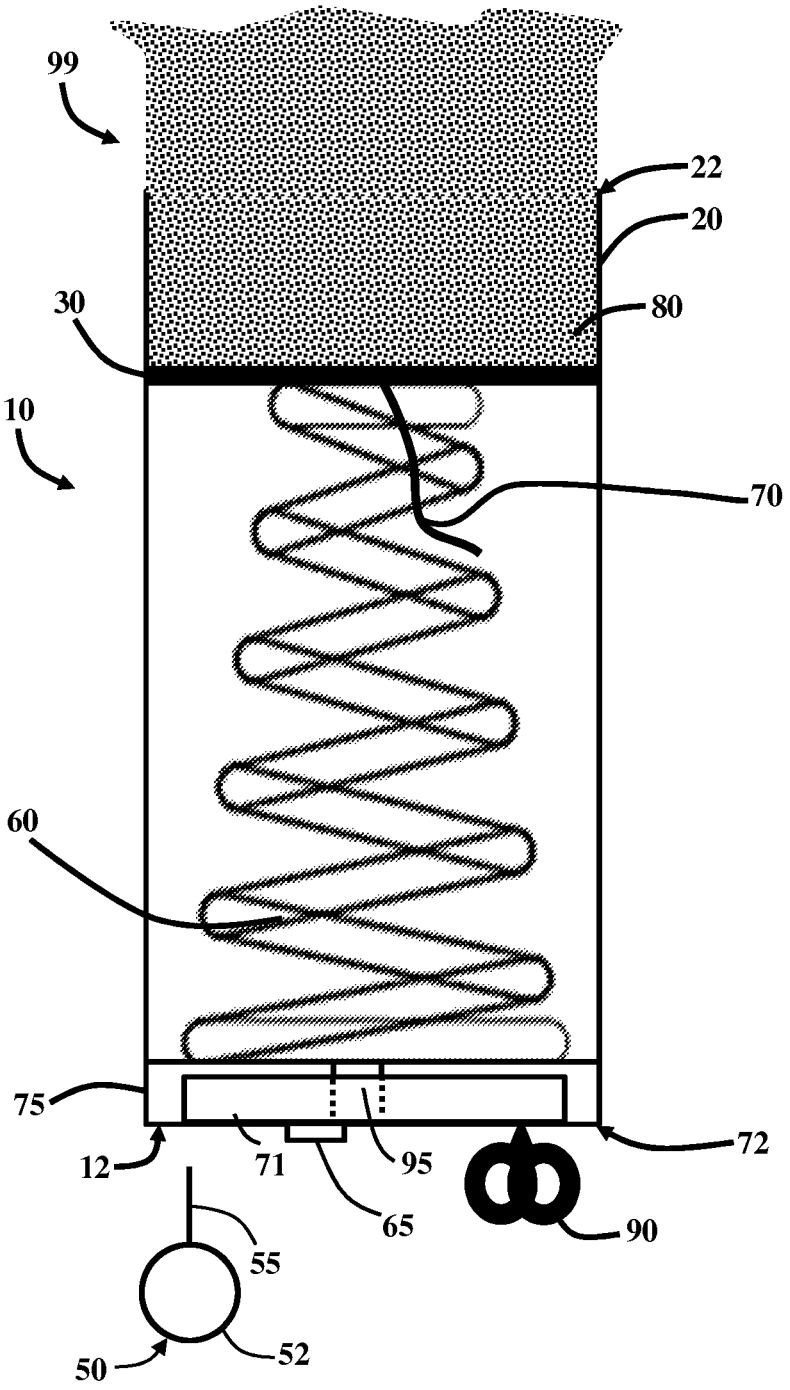
FIG. 3C illustrates a sectional view the spring powered disseminator of FIG. 3A upon actuation according to an embodiment herein.

An actuating mechanism 50 comprising a pull ring 52 connected to a safety pin 55 is configured through the base 72 of the body portion 12 into the time delay fuze 71, and secures the disseminator 10. When the time comes to operate the disseminator 10, the safety pin 55 is removed by a user (not shown) to energize the delay sequence. The control mechanism 90 controls the delay sequence, wherein the control mechanism 90 may be embodied as a knob or button on the base 72 of the body portion 12. A delay time could be selected, and the initiator mechanism 65 is selected to start the delay count down. The disseminator 10 would then be thrown by an operator (not shown). Once the delay time expires, the dislodgment mechanism (e.g., cutting mechanism) 95 inside the second compartment 75 severs the piston retention cable 70, as shown in FIG. 3C which shows the severed cable 70. Then, the energy storage device (e.g., spring) 60 uncoils, placing pressure on the force transfer device (e.g., piston) 30 and payload powder 80. The energy storage device (e.g., spring) 60 and force transfer device (e.g., piston) 30 forces the powder payload 80 against the cover 15 across the top 22 of the body portion 12 rupturing the cover 15 for an instantaneous release of the powder 80 in the form of a cloud of aerosol 99. With the force transfer device (e.g., piston) 30 attached to the energy storage device (e.g., spring) 60, the force transfer device (e.g., piston) 30 remains inside the body portion 12, with no danger of it flying off as a projectile and causing injury.

Figure 3D:
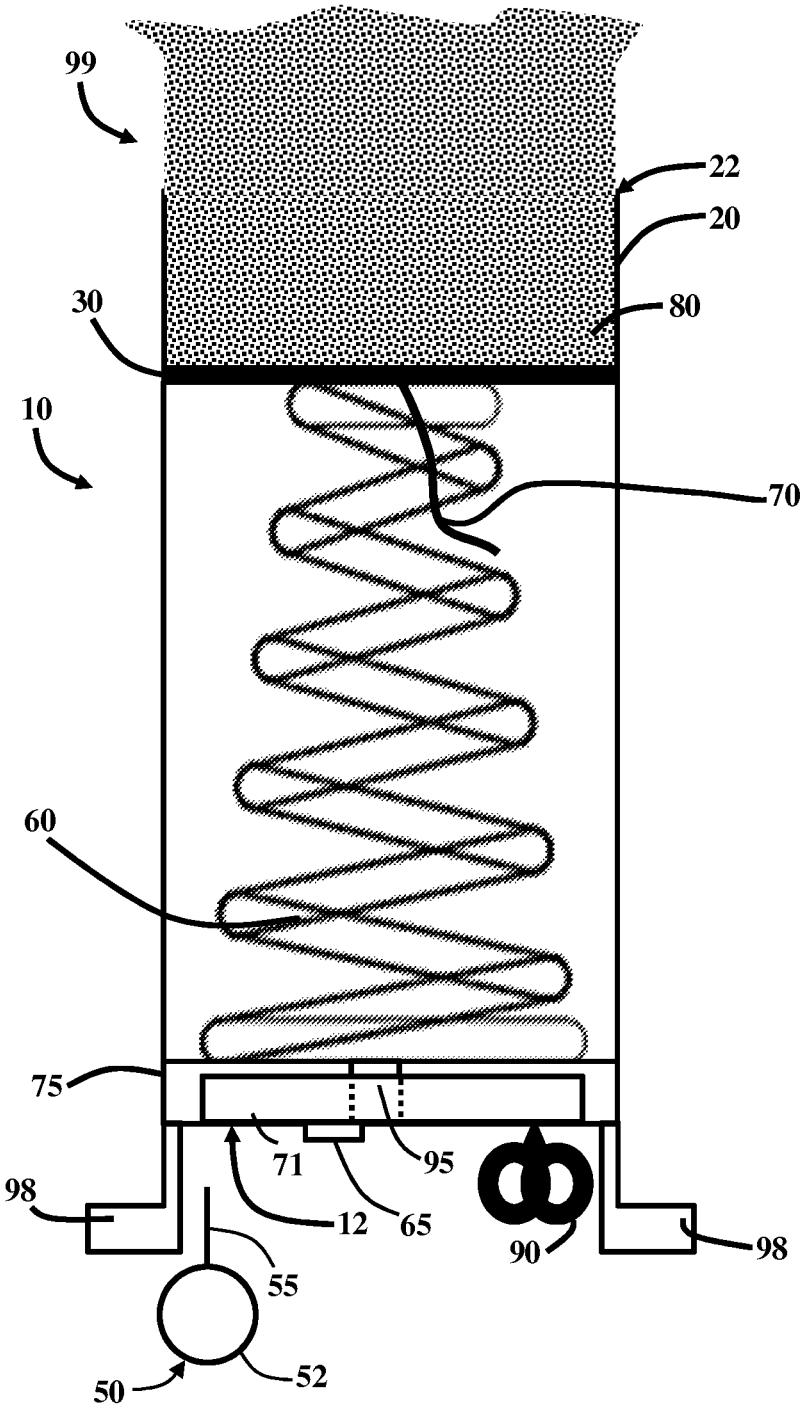
FIG. 3D illustrates a sectional view the spring powered disseminator of FIG. 3A upon actuation according to another embodiment herein.

The non-pyrotechnic powder disseminator 10 eliminates the risk of fire as well as the risk of personnel being burned by a hot grenade body. The disseminator 10 could safely be used in confined spaces and within combustible environments. The non-pyrotechnic powder disseminator 10 increases safety by eliminating fire and shrapnel hazards and reducing handling and storage restrictions. Furthermore, the disseminator 10 produces an almost instantaneous cloud of aerosol 99, as shown in FIGS. 3C and 3D, similar to that produced by a pyrotechnic or explosive device without the associated injury from shrapnel and ejected parts. Full pyrotechnic devices or devices with small amounts of pyrotechnics in the fuze and delay assemblies require special care for handling and storage. However, a completely non-pyrotechnic disseminator 10, as provided by the embodiments herein, eliminates many of the hazards associated with current inventoried and commercial pyrotechnic and explosive riot control grenades and has fewer restrictions on storage and handling.

In addition, alternative embodiments may also include any material that is suitable for use in the construction of the non-pyrotechnic disseminator 10, and the type of disseminating materials being disseminated could include slurries and liquids in addition to or alternative to the powder 80 described above. Further embodiments, as shown in FIG. 3D, can include using a self-righting mechanism 98 operatively connected to the grenade body portion 12, such as spring actuated legs or a "roly poly" apparatus to increase the dissemination efficiency of the embodiments herein, by orienting the disseminator 10 so that the powder 80 (or slurry or liquid) will be disseminated into the air as opposed to parallel to the ground.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A non-pyrotechnic disseminator comprising:

a body portion;

a cover on said body portion;

a first compartment adjacent to said cover, wherein said first compartment is configured to hold disseminating materials;

a piston in said first compartment;

a spring attached to said piston and a base of said first compartment;

a cable connecting said piston to a base of said body portion;

a second compartment adjacent to said first compartment;

a control mechanism operatively connected to said second compartment; and an initiator mechanism operatively connected to said second compartment and wherein said second compartment includes a delay fuze module and a cutting mechanism adjacent to said cable and adapted to cut said cable.

2. The non-pyrotechnic disseminator of claim 1, wherein said control mechanism sets a delay timing countdown for initiation of dissemination of said disseminating materials out of said body portion.

3. The non-pyrotechnic disseminator of claim 2, wherein said initiator mechanism begins said delay timing countdown.

4. The non-pyrotechnic disseminator of claim 2, wherein said delay fuze module processes said delay timing countdown, and upon expiration of the countdown, sends a signal to said cutting mechanism to cut said cable.

5. The non-pyrotechnic disseminator of claim 4, wherein upon cutting of said cable, said spring uncoils and pushes said piston towards said cover thereby pushing said disseminating materials out of said body portion by rupturing said cover.

6. The non-pyrotechnic disseminator of claim 5, wherein said disseminating materials exit said body portion as an aerosol.

7. The non-pyrotechnic disseminator of claim 4, further comprising an actuating mechanism operatively connected to said second compartment, wherein actuation of said actuating mechanism activates said delay fuze module, allowing the delay timing countdown to be set by said control mechanism and initiated by said initiator mechanism, and wherein expiration of said countdown immediately causes said cutting mechanism to cut said cable.

8. The non-pyrotechnic disseminator of claim 1, wherein said disseminating materials comprise any of a powder, slurry, and liquid.

9. The non-pyrotechnic disseminator of claim 1, further comprising a self-righting mechanism operatively connected to said body portion.

10. A grenade comprising:

a body portion;

a first compartment configured in said body portion, wherein said first compartment is configured to hold disseminating materials;

a force transfer device in said first compartment;

an energy storage device attached to said force transfer device;

a cable connecting said force transfer device to a base of said body portion thereby compressing said energy storage device;

a control mechanism operatively connected to said body portion;

an initiator mechanism operatively connected to said body portion; and a second compartment adjacent to said first compartment and wherein said second compartment includes a delay fuze module and a dislodgement mechanism for dislodging said cable.

11. The grenade of claim 10, further comprising:

a cover on said body portion; and wherein said energy storage device is attached to a base of said first compartment, and wherein said control mechanism sets a delay timing countdown for initiation of dissemination of said disseminating materials out of said body portion.

12. The grenade of claim 11, wherein said initiator mechanism begins said delay timing countdown.

13. The grenade of claim 11, wherein said delay fuze module processes said delay timing countdown, and upon expiration of the countdown, sends a signal to said dislodgment mechanism to dislodge said cable.

14. The grenade of claim 13, wherein upon dislodging of said cable, said energy storage device transfers energy to said force transfer device, which transfers a force towards said cover thereby pushing said disseminating materials out of said body portion by rupturing said cover.

15. The grenade of claim 13, further comprising an actuating mechanism operatively connected to said second compartment, wherein actuation of said actuating mechanism sends a signal to said delay fuze module, and wherein expiration of said countdown immediately causes said dislodgment mechanism to dislodge said cable from said base of said body portion.

16. The grenade of claim 10, wherein said disseminating materials exit said body portion as an aerosol.

17. The grenade of claim 10, wherein said disseminating materials comprise any of a powder, slurry, and liquid.

18. The grenade of claim 10, further comprising a self-righting mechanism operatively connected to said body portion.

* * * * *